US009000950B2

(12) United States Patent
Cannizzaro et al.

(10) Patent No.: US 9,000,950 B2
(45) Date of Patent: Apr. 7, 2015

(54) MANAGING VEHICLE DETECTION

(71) Applicant: International Business Machines Corporation, Armonk, NY (US)

(72) Inventors: Giovanna Cannizzaro, Rome (IT); Patrizia Manganelli, Rome (IT); Elisa Matteagi, Rome (IT); Alessandro Raniolo, Rome (IT)

(73) Assignee: International Business Machines Corporation, Armonk, NY (US)

( * ) Notice: Subject to any disclaimer, the term of this patent is extended or adjusted under 35 U.S.C. 154(b) by 8 days.

(21) Appl. No.: 13/675,907

(22) Filed: Nov. 13, 2012

(65) Prior Publication Data

US 2014/0132426 A1 May 15, 2014

(51) Int. Cl.
*G08G 1/01* (2006.01)
*G08G 1/16* (2006.01)

(52) U.S. Cl.
CPC ..... *G08G 1/163* (2013.01)

(58) Field of Classification Search
USPC ..... 340/935, 435, 988, 436, 463; 701/36, 701/301
See application file for complete search history.

(56) References Cited

U.S. PATENT DOCUMENTS 5,045,856 A 9/1991 Paoletti
7,426,437 B2 * 9/2008 Breed et al. ..... 701/301
7,485,199 B2 * 2/2009 Sugahara ..... 148/427
7,523,000 B2 * 4/2009 Tengler et al. ..... 701/301
7,646,331 B2 1/2010 Ruby et al.
8,000,897 B2 8/2011 Breed et al.
8,255,144 B2 * 8/2012 Breed et al. ..... 701/117
2005/0134440 A1 6/2005 Breed
2007/0083296 A1 * 4/2007 Tengler et al. ..... 701/1
2007/0162550 A1 * 7/2007 Rosenberg ..... 709/206
2008/0091352 A1 4/2008 O'Hare
2009/0228172 A1 * 9/2009 Markyvech et al. ..... 701/36
2010/0020170 A1 1/2010 Higgins-Luthman et al.

OTHER PUBLICATIONS

GPSenseCar—A collision avoidance support system using real-time GPS data in a mobile vehicular network, Chen et al, Systems and Networks Communications 2006, ICSNC '06, Oct. 2006, published on the world wide web at http://ieeexplore.ieee.org/xpl/login.jsp?tp=&arnumber=4041586&url=http%3A%2F%2Fieeexplore.ieee.org%2Fiel5%2F4041508%2F4041509%2F04041586.pdf%3Farnumber%3D4041586.

(Continued)

*Primary Examiner* — Phung Nguyen
(74) *Attorney, Agent, or Firm* — Paul S. Drake

(57) ABSTRACT

A method, system or computer usable program product for a wireless unit of a first vehicle detecting and locating other nearby vehicles including emitting a first short range wireless signal with the first wireless unit, the first wireless signal including a first unique identifier and a first location of the first vehicle, detecting a second short range wireless signal of a second wireless unit of a second vehicle without the first wireless unit establishing a connection with the second wireless unit, the second wireless signal including a second unique identifier and a second location of the second vehicle, and computing a relative location of the second vehicle from the second wireless signal.

20 Claims, 8 Drawing Sheets

(56) References Cited

OTHER PUBLICATIONS

"GPS based Vehicular Collision Warning System using IEEE 802.15.4 MAC/PHY Standard", Anurag et al, ITS Telecommunications, 2008, 8th International Conference on Oct. 24, 2008, published on the world wide web at: https://facultylive.iimcal.ac.in/sites/facultylive.iimcal.ac.in/files/17-GPS.pdf.

"Skyhook Wireless Hybrid Positioning System", Skyhookwireless.com, Jul. 5, 2008 with content from 2007, found on the world wide web at: https://web.archive.org/web/20080705101428/http://www.skyhookwireless.com/howitworks/xps.php.

* cited by examiner

MANAGING VEHICLE DETECTION

BACKGROUND

1. Technical Field

The present invention relates generally to managing vehicle detection, and in particular, to a computer implemented method for utilizing short range wireless communications to detect and locate other similarly equipped vehicles.

2. Description of Related Art

Vehicle collisions are costly and may cause injury or death for the occupants or other nearby persons. As a result, vehicles are now better designed and built to protect their occupants. This includes the use of anti-lock braking systems, seatbelts, head rests and air bags. In addition, vehicles are better designed with laminated windshields, padded interiors, crumple zones and side impact protection beams. Furthermore, roadways are better designed and marked to help reduce collisions. More recently, various electronic devices have been suggested and implemented in some high value vehicles to reduce collisions such as radar equipped vehicles. While these efforts have reduced the number of injuries and deaths per mile or kilometer driven, there is still a need to further reduce the number of vehicle collisions.

SUMMARY

The illustrative embodiments provide a method, system, and computer usable program product for a wireless unit of a first vehicle detecting and locating other nearby vehicles including emitting a first short range wireless signal with the first wireless unit, the first wireless signal including a first unique identifier and a first location of the first vehicle, detecting a second short range wireless signal of a second wireless unit of a second vehicle without the first wireless unit establishing a connection with the second wireless unit, the second wireless signal including a second unique identifier and a second location of the second vehicle, and computing a relative location of the second vehicle from the second wireless signal.

BRIEF DESCRIPTION OF THE SEVERAL VIEWS OF THE DRAWINGS

The novel features believed characteristic of the invention are set forth in the appended claims. The invention itself, further objectives and advantages thereof, as well as a preferred mode of use, will best be understood by reference to the following detailed description of illustrative embodiments when read in conjunction with the accompanying drawings, wherein:

DETAILED DESCRIPTION

Processes and devices may be implemented and utilized for detecting and displaying other nearby vehicles. These processes and apparatuses may be implemented and utilized as will be explained with reference to the various embodiments below.

Figure 1:
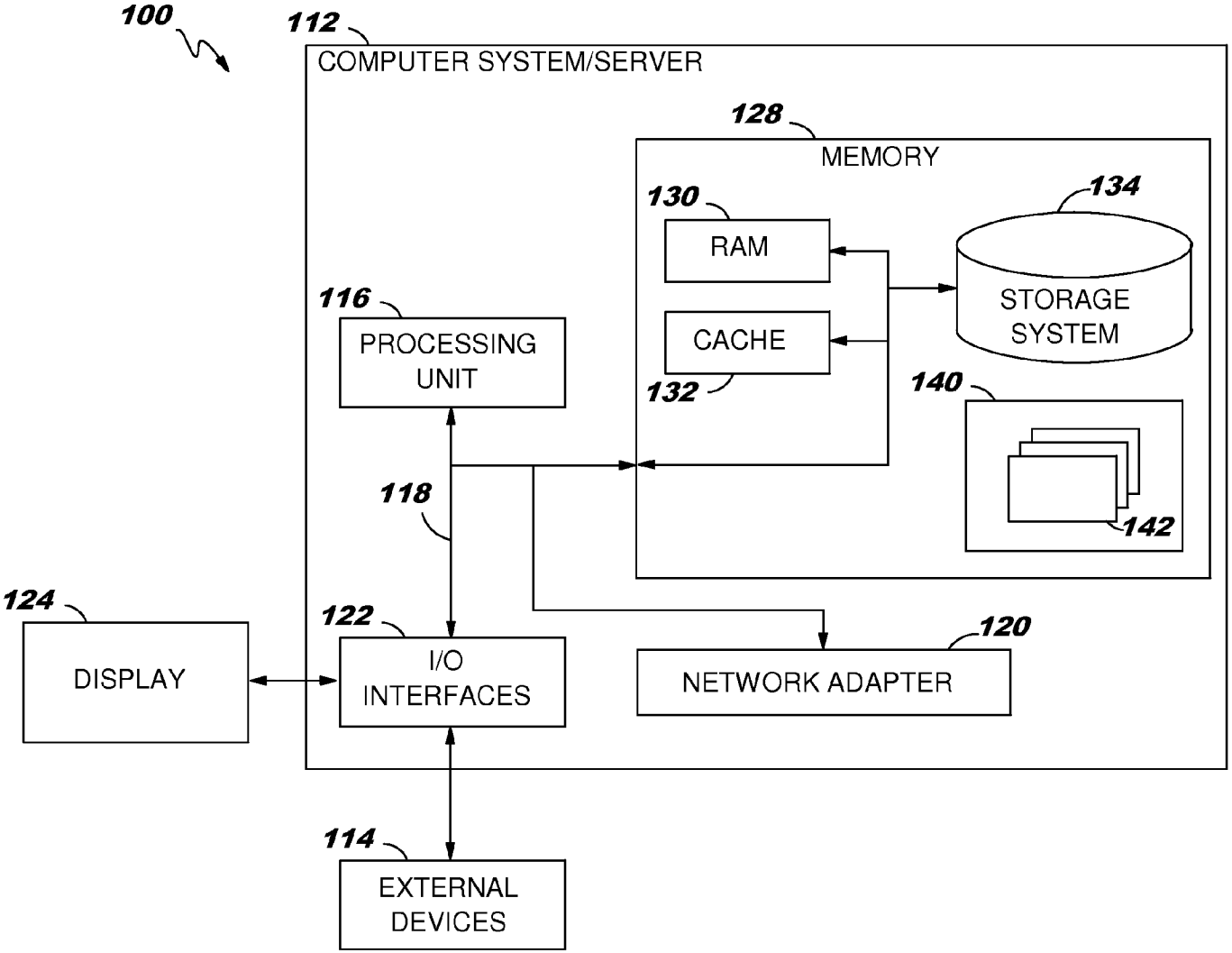
FIG. 1 is a block diagram of a data processing system in which various embodiments may be implemented.

FIG. 1 is a block diagram of a data processing system in which various embodiments may be implemented. Data processing system 100 is one example of a suitable data processing system and is not intended to suggest any limitation as to the scope of use or functionality of embodiments of the invention described herein. Regardless, data processing system 100 is capable of being implemented and/or performing any of the functionality set forth herein.

In data processing system 100 there is a computer system/server 112, which is operational with numerous other general purpose or special purpose computing system environments, peripherals, or configurations. Examples of well-known computing systems, environments, and/or configurations that may be suitable for use with computer system/server 112 include, but are not limited to, personal computer systems, server computer systems, thin clients, thick clients, hand-held or laptop devices, multiprocessor systems, microprocessor-based systems, set top boxes, programmable consumer electronics, network PCs, minicomputer systems, mainframe computer systems, and distributed cloud computing environments that include any of the above systems or devices, and the like.

Computer system/server 112 may be described in the general context of computer system-executable instructions, such as program modules, being executed by a computer system. Generally, program modules may include routines, programs, objects, components, logic, data structures, and so on that perform particular tasks or implement particular abstract data types. Computer system/server 112 may be practiced in distributed computing environments where tasks are performed by remote processing devices that are linked through a communications network. In a distributed computing environment, program modules may be located in both local and remote computer system storage media including memory storage devices.

As shown in FIG. 1, computer system/server 112 in data processing system 100 is shown in the form of a general-purpose computing device. The components of computer system/server 112 may include, but are not limited to, one or more processors or processing units 116, a system memory 128, and a bus 118 that couples various system components including system memory 128 to processing unit 116.

Bus 118 represents one or more of any of several types of bus structures, including a memory bus or memory controller, a peripheral bus, an accelerated graphics port, and a processor or local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnects (PCI) bus.

Computer system/server 112 typically includes a variety of computer system readable media. Such media may be any available media that is accessible by computer system/server 112, and it includes both volatile and non-volatile media, removable and non-removable media.

System memory 128 can include computer system readable media in the form of volatile memory, such as random access memory (RAM) 130 and/or cache memory 132. Computer system/server 112 may further include other removable/non-removable, volatile/non-volatile computer system storage media. By way of example, storage system 134 can be provided for reading from and writing to a non-removable, non-volatile magnetic media (not shown and typically called a "hard drive"). Although not shown, a magnetic disk drive for reading from and writing to a removable, non-volatile magnetic disk (e.g., a "floppy disk"), and an optical disk drive for reading from or writing to a removable, non-volatile optical disk such as a CD-ROM, DVD-ROM or other optical media can be provided. In such instances, each can be connected to bus 118 by one or more data media interfaces. Memory 128 may include at least one program product having a set (e.g., at least one) of program modules that are configured to carry out the functions of embodiments of the invention. Memory 128 may also include data that will be processed by a program product.

Program/utility 140, having a set (at least one) of program modules 142, may be stored in memory 128 by way of example, and not limitation, as well as an operating system, one or more application programs, other program modules, and program data. Each of the operating system, one or more application programs, other program modules, and program data or some combination thereof, may include an implementation of a networking environment. Program modules 142 generally carry out the functions and/or methodologies of embodiments of the invention. For example, a program module may be software for detecting and displaying other nearby vehicles.

Computer system/server 112 may also communicate with one or more external devices 114 such as a keyboard, a pointing device, a display 124, etc.; one or more devices that enable a user to interact with computer system/server 112; and/or any devices (e.g., network card, modem, etc.) that enable computer system/server 112 to communicate with one or more other computing devices. Such communication can occur via I/O interfaces 122 through wired connections or wireless connections. Still yet, computer system/server 112 can communicate with one or more networks such as a local area network (LAN), a general wide area network (WAN), and/or a public network (e.g., the Internet) via network adapter 120. As depicted, network adapter 120 communicates with the other components of computer system/server 112 via bus 118. It should be understood that although not shown, other hardware and/or software components could be used in conjunction with computer system/server 112. Examples, include, but are not limited to: microcode, device drivers, tape drives, RAID systems, redundant processing units, data archival storage systems, external disk drive arrays, etc.

Figure 2:
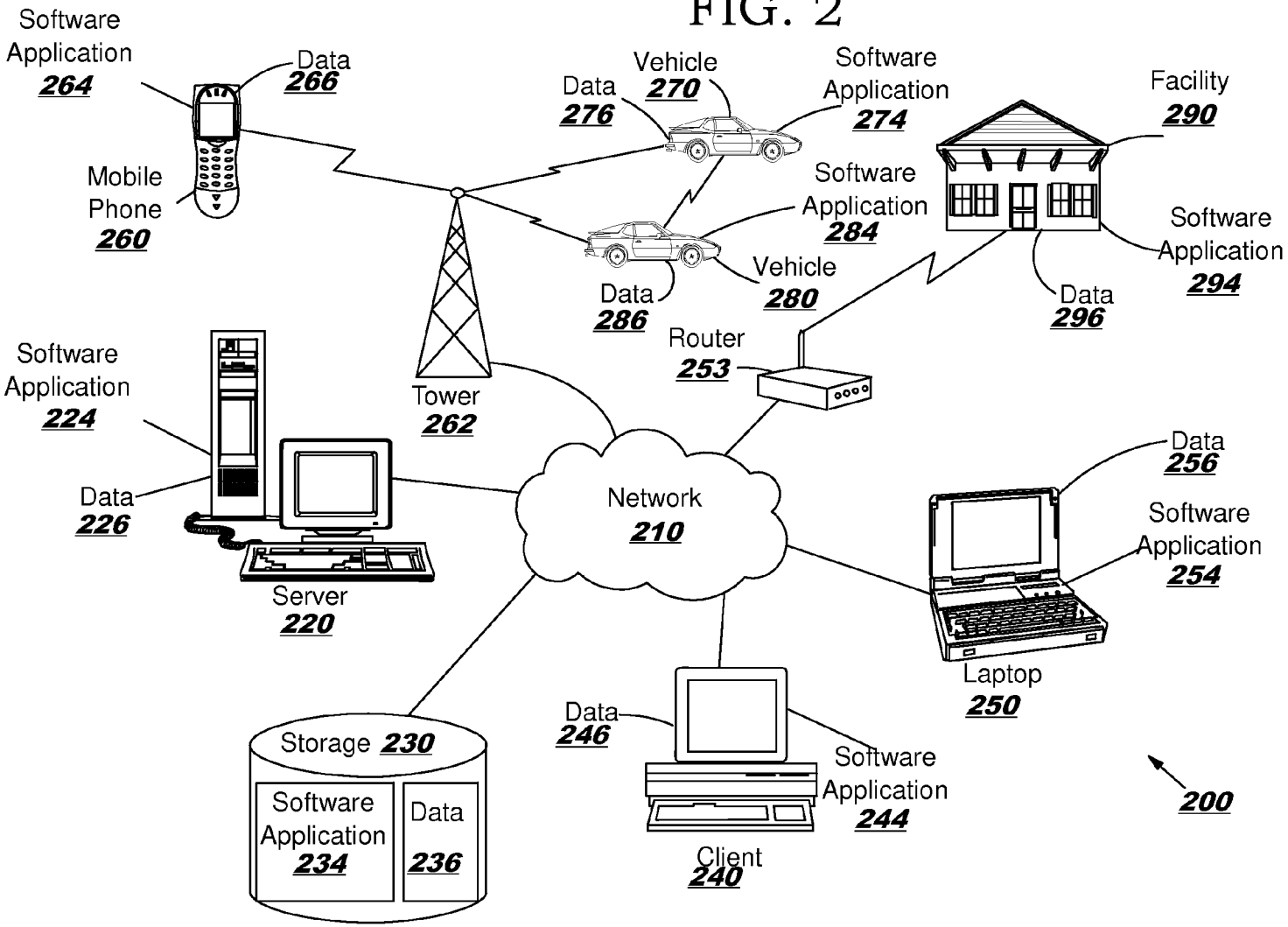
FIG. 2 is a block diagram of a network of data processing systems in which various embodiments may be implemented.

FIG. 2 is a block diagram of a network of data processing systems in which various embodiments may be implemented. Data processing environment 200 is a network of data processing systems such as described above with reference to FIG. 1. Software applications may execute on any computer or other type of data processing system in data processing environment 200. Data processing environment 200 includes network 210. Network 210 is the medium used to provide simplex, half duplex and/or full duplex communications links between various devices and computers connected together within data processing environment 200. Network 210 may include connections such as wire, wireless communication links, or fiber optic cables.

Server 220 and client 240 are coupled to network 210 along with storage unit 230. In addition, laptop 250 and facility 290 (such as a home or business) are coupled to network 210 including wirelessly such as through a network router 253. A mobile phone 260, vehicle 270 and vehicle 280 may be coupled to network 210 through a mobile phone tower 262. Vehicle 270 and vehicle 280 may also communicate with each other wirelessly such as through a Bluetooth connection. Data processing systems, such as server 220, client 240, laptop 250, mobile phone 260, vehicle 270, vehicle 280, and facility 290 contain data and have software applications including software tools executing thereon. Other types of data processing systems such as personal digital assistants (PDAs), smartphones, tablets and netbooks may be coupled to network 210.

Server 220 may include software application 224 and data 226 for detecting and displaying other nearby vehicles or other software applications and data in accordance with embodiments described herein. Storage 230 may contain software application 234 and a content source such as data 236 for identifying nearby vehicles for display. Other software and content may be stored on storage 230 for sharing among various computer or other data processing devices. Client 240 may include software application 244 and data 246. Laptop 250 and mobile phone 260 may also include software applications 254 and 264 and data 256 and 266. Vehicles 270 and 280 may include software applications 274 and 284 as well as data 276 and 286. Facility 290 may include software applications 294 and data 296. Other types of data processing systems coupled to network 210 may also include software applications. Software applications could include a web browser, email, or other software application that can detect and display other nearby vehicles.

Server 220, storage unit 230, client 240, laptop 250, mobile phone 260, vehicle 270, vehicle 280 and facility 290 and other data processing devices may couple to network 210 using wired connections, wireless communication protocols, or other suitable data connectivity. Client 240 may be, for example, a personal computer or a network computer.

In the depicted example, server 220 may provide data, such as boot files, operating system images, and applications to client 240 and laptop 250. Server 220 may be a single computer system or a set of multiple computer systems working together to provide services in a client server environment. Client 240 and laptop 250 may be clients to server 220 in this example. Client 240, laptop 250, mobile phone 260, vehicle 270, vehicle 280 and facility 290 or some combination thereof, may include their own data, boot files, operating system images, and applications. Data processing environment 200 may include additional servers, clients, and other devices that are not shown.

In the depicted example, data processing environment 200 may be the Internet. Network 210 may represent a collection of networks and gateways that use the Transmission Control Protocol/Internet Protocol (TCP/IP) and other protocols to communicate with one another. At the heart of the Internet is a backbone of data communication links between major nodes or host computers, including thousands of commercial, governmental, educational, and other computer systems that route data and messages. Of course, data processing environment 200 also may be implemented as a number of different types of networks, such as for example, an intranet, a local area network (LAN), or a wide area network (WAN). FIG. 2 is intended as an example, and not as an architectural limitation for the different illustrative embodiments.

Among other uses, data processing environment 200 may be used for implementing a client server environment in which the embodiments may be implemented. A client server environment enables software applications and data to be distributed across a network such that an application functions by using the interactivity between a client data processing system and a server data processing system. Data processing environment 200 may also employ a service oriented architecture where interoperable software components distributed across a network may be packaged together as coherent business applications.

Figure 3A:
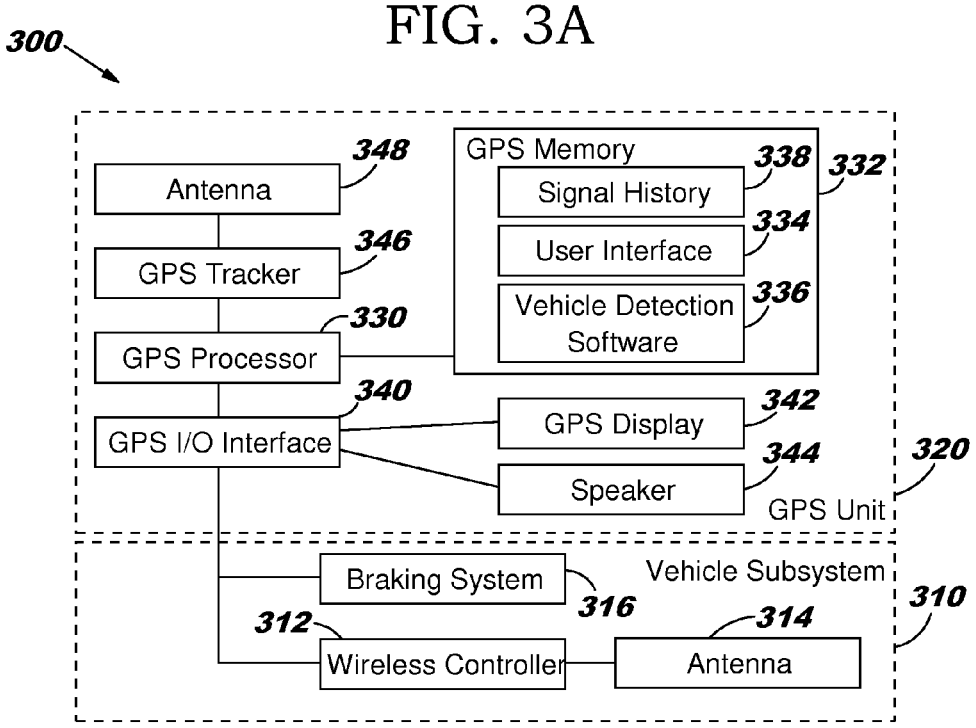
FIGS. 3A and 3B are block diagrams of a vehicular system for detecting and displaying nearby vehicles for a user in which various embodiments may be implemented.
Figure 3B:
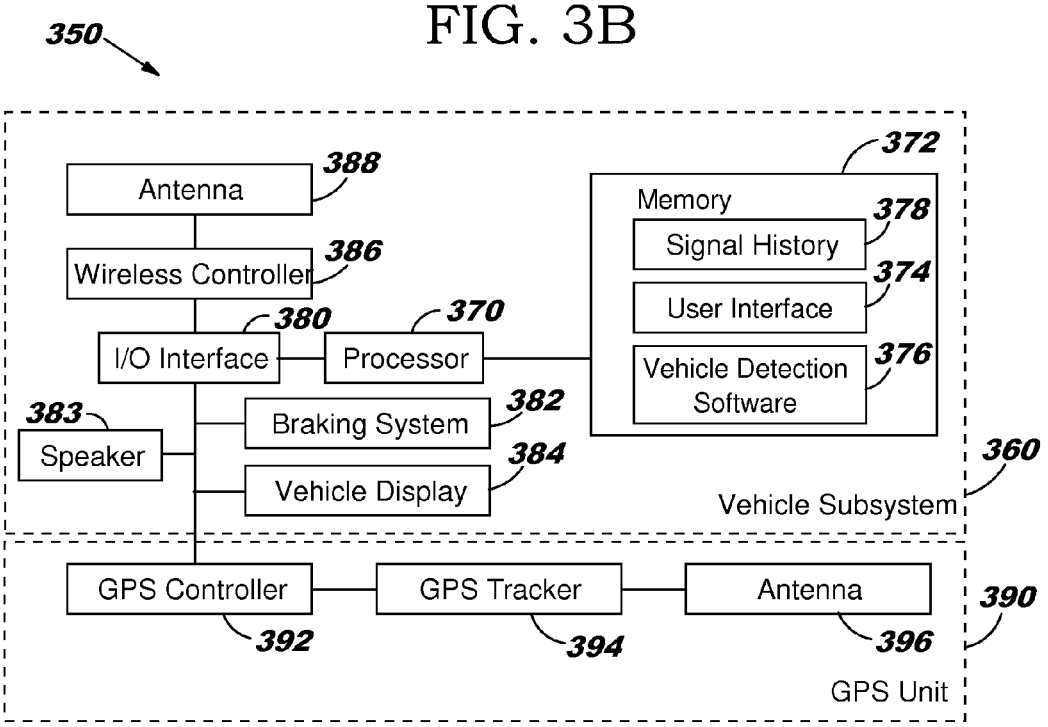

FIGS. 3A and 3B are block diagrams of a vehicular system for detecting and displaying nearby vehicles for a user in which various embodiments may be implemented. FIG. 3A is a block diagram of a first vehicular system 300 for detecting and displaying nearby vehicles. This first vehicular system includes a vehicle subsystem 310 and a GPS (global positioning system) unit 320. The GPS unit may utilize a variety of signals to determine its position including satellite based positioning systems, ground based positioning systems, ground based supplements to satellite based systems, or a combination thereof. The GPS unit may utilize satellite signals from the United States Global Positioning System, the European Union Galileo positioning system, the Chinese, Compass navigation system, the Indian Navigational satellite system, or any combination thereof. In this system, the GPS unit is not tightly integrated with the vehicle subsystem and could be a removable unit added to the vehicle after it was manufactured.

Vehicle subsystem 310 includes a wireless controller 312 and a braking system 316, both of which are in communication with GPS unit 320. The wireless controller manages wireless communications with other vehicles through antenna 314. These wireless communications may be Bluetooth or other type of short range wireless communications. Wireless controller may also utilize other types of wireless communications such as cellular, WiFi, WiMax, etc. Additional wireless controllers in communication with GPS unit 320 may also be utilized. The wireless control is utilized to communicate with other nearby vehicles, either directly or indirectly, in order to determine their relative location, speed and direction. Short range wireless communications are preferred to limit the number of vehicles that may be detected and communicated with thereby simplifying communications and processing. Short range may be less than 400 meters or even less than 100 meters. The range needed may be dependent in the speed of the vehicle. For example, while driving on fog at about or 50 kilometers per hour (approximately 30 miles per hour) a 100 meter range may be adequate. Although a longer range is preferred (100 meters to 400 meters) at higher speeds, a shorter range may be effective since most vehicles of concern are traveling the same direction. The wireless controller may also be capable of providing information regarding the signal attributes, such as frequency, signal direction and signal strength, for processing as described below with reference to FIG. 6A. Braking system 316 may be utilized to slow the vehicle in case a possible collision is detected. Alternative embodiments may include connections to an accelerator, steering and cruise control of the user's vehicle.

GPS unit 320 includes a GPS processor 330 which utilizes a GPS memory 332. GPS memory 332 includes a user interface 334 for communicating with the user and vehicle detection software 336 for detecting the relative location, speed and direction of nearby vehicles based on communications. GPS memory 332 also includes signal history 338 containing the history of prior communications and analysis thereof of other nearby vehicles. GPS processor 330 also utilizes a GPS I/O (input/output) interface 340 for communicating with elements of vehicle subsystem 310 as well as a GPS display 342 and speaker 344. User interface software 334 is able to communicate with a user through GPS display 342 and speaker 344. GPS processor 330 also communicates with GPS tracker 346 using antenna 348 which can determine the current location, speed and direction of the user vehicle. This information is utilized to provide the location of the user vehicle to other vehicles, and to determine the relative location, speed and direction of other nearby vehicles.

FIG. 3B is a block diagram of a second vehicular system 350 for detecting and displaying nearby vehicles. This second system includes a vehicle subsystem 360 and a GPS unit 390. The GPS unit may utilize a variety of signals to determine its position including satellite based positioning systems, ground based positioning systems, ground based supplements to satellite based systems, or a combination thereof. The GPS unit may utilize satellite signals from the United States Global Positioning System, the European Union Galileo positioning system, the Chinese Compass navigation system, the Indian Navigational satellite system, or any combination thereof. In this vehicular system, the GPS unit is more tightly integrated with the vehicle subsystem.

Vehicle subsystem 360 includes a processor 370 which utilizes a memory 372. Memory 372 includes a user interface 374 for communicating with the user and vehicle detection software 376 for detecting the relative location, speed and direction of nearby vehicles based on communications. Memory 372 also includes signal history 378 containing the history of prior communications and analysis thereof of other nearby vehicles. Processor 370 also utilizes an I/O (input/output) interface 380 for communicating with elements of GPS unit 390, braking system 382, speaker 383, vehicle display 384 and wireless controller 386. Braking system 382 may be utilized to slow the vehicle in case a possible collision is detected. Alternative embodiments may include connections to an accelerator, steering and cruise control of the user's vehicle. User interface software 374 is able to communicate with a user through speaker 383 and vehicle display 384. Vehicle display 384 may be a standard liquid crystal display or other similar flat screen display. Vehicle display 384 may also be a heads up display projected onto the windshield in front of a driver. Wireless controller 386 manages wireless communications with other vehicles through antenna 388. These wireless communications may be Bluetooth or other type of short range wireless communications. Wireless controller may also utilize other types of wireless communications such as cellular, WiFi, WiMax, etc. Additional wireless controllers in communication with processor 370 may also be utilized. The wireless control is utilized to communicate with other nearby vehicles, either directly or indirectly, in order to determine their relative location, speed and direction. Short range wireless communications are preferred to limit the number of vehicles that may be detected and communicated with thereby simplifying communications and processing. Short range may be less than 400 meters or even less than 100 meters. The range needed may be dependent on the speed of the vehicle. For example, while driving in fog at about or 50 kilometers per hour (approximately 30 miles per hour) a 100 meter range may be adequate. Although a longer range is preferred (100 meters to 400 meters) at higher speeds, a shorter range may be effective since most vehicles of concern are traveling the same direction. The wireless controller may also be capable of providing information regarding the signal attributes, such as frequency, signal direction and signal strength, for processing as described below with reference to FIG. 6A.

GPS unit 390 includes a GPS controller 392 in communication with I/O interface 380. GPS controller 392 communicates with a GPS tracker which utilizes an antenna 396 to determine the position, speed and direction of the user's vehicle. This information is utilized to provide the location of the user vehicle to other vehicles, and to determine the relative location, speed and direction of other nearby vehicles.

Figure 4A:
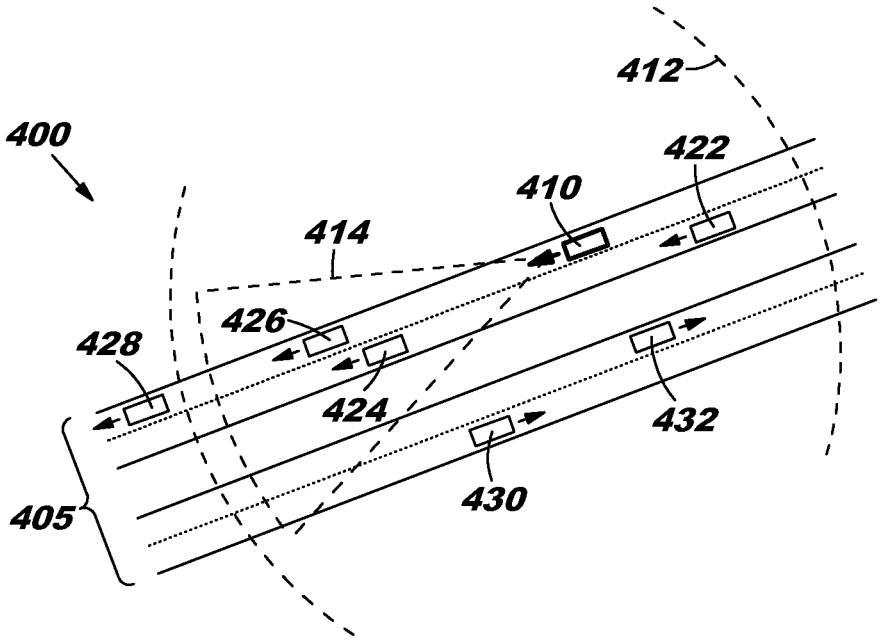
FIGS. 4A and 4B are illustrations demonstrating a position and direction of the user's vehicle relative to other nearby vehicles in which various embodiments may be implemented.
Figure 4B:
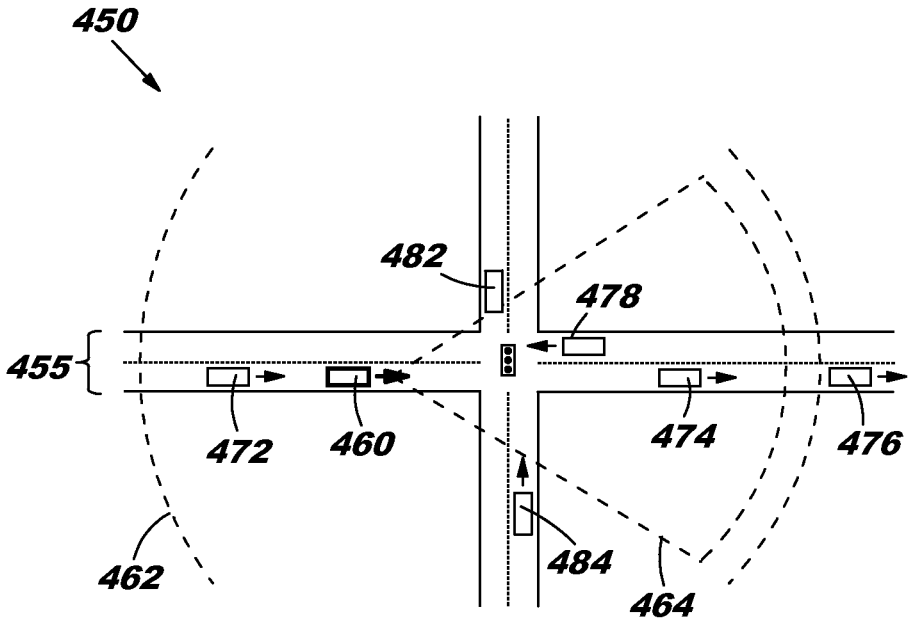
Figure 5:
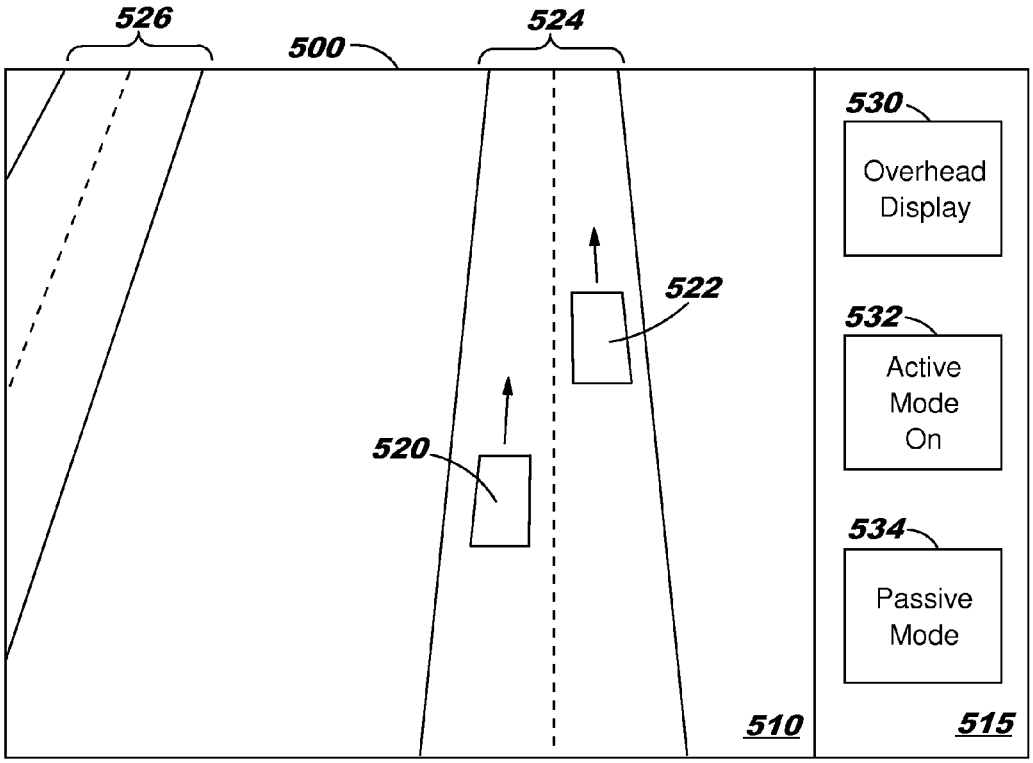
FIG. 5 illustrates a user interface displayed for a user in which various embodiments may be implemented.

FIGS. 4A and 4B are illustrations demonstrating a position and direction of the user's vehicle relative to other nearby vehicles in which various embodiments may be implemented. FIG. 4A illustrates a highway system 400 with a four lane divided highway 405. A user vehicle 410 is able to detect vehicles within a range 412. Range 412 depends on the capabilities of a wireless system utilized by the user vehicle as well as local conditions. For example, local obstructions such as bridges or hills may obstruct the range. In addition, weather conditions may also affect the range. User vehicle 410 also has a display range 414 which is the range of vehicles shown on a user vehicle display in one possible mode of operation as shown in FIG. 5 below. Alternative modes of operation such as an overhead view may display all vehicles within range 400.

User vehicle 410 is headed towards the west south west (towards the left of the illustration). Other vehicles are shown including vehicles 422, 424, 426 and 428 also headed towards the west south west, and vehicles 430 and 432 headed towards the east north east. Vehicle 428 is outside of the range of the user vehicle, so it may not be detected. All other vehicles are within range, so they may detectable as described below. Only vehicles 424 and 426 are within the display range 414, so those vehicles may be displayed for the user as shown below with reference to FIG. 5.

FIG. 4B illustrates a highway system 450 with a light controlled intersection between two streets 455. A user vehicle 460 is able to detect vehicles within a range 462. Range 462 depends on the capabilities of a wireless system utilized by the user vehicle as well as local conditions. For example, local obstructions such as bridges or hills may obstruct the range. In addition, weather conditions may also affect the range. User vehicle 460 also has a display range 464 which is the range of vehicles shown on a user vehicle display in one possible mode of operation. Alternative modes of operation such as an overhead view may display all vehicles within range 462.

User vehicle 460 is headed towards the east (towards the right of the illustration). Other vehicles are shown including vehicles 472, 474 and 476 also headed towards the east, vehicle 478 headed towards the west, stationary vehicle 482, and northbound vehicle 484. Vehicle 476 is outside of the range of the user vehicle, so it may not be detected. All other vehicles are within range, so they may detectable as described below. Only vehicles 474, 478 and 482 are within the display range 464, so those vehicles may be displayed for the user.

FIG. 5 illustrates a user interface displayed for a user in which various embodiments may be implemented. In this embodiment, display 500 is a touch sensitive split screen. The majority of the split screen 510 is used to display the approaching highway and vehicles, and a minority of the split screen 515 used to display various choices for the user to select. Split screen 510 illustrates what a driver would see ahead based on display range 414 in the example shown in FIG. 4A above. There are two vehicles 520 and 522 ahead also headed the same direction on the same side of the highway 524. A portion of the other side of the highway 526 is also displayed.

Split screen 515 includes three touch sensitive buttons. A top button 530 labeled "Overhead Display" may be pressed by the user resulting in the display changing the image shown to an overhead view similar to FIG. 4A. A middle button 532 labeled "Active Mode ON" indicates to the user that the vehicle display is currently in an active mode. This mode will be explained further below with reference to FIG. 6A. A bottom button 534 labeled "Passive Mode" may be pressed by the user resulting in the vehicle display changing from an active mode to a passive mode. This mode will be explained further below with reference to FIG. 6B.

Figure 6A:
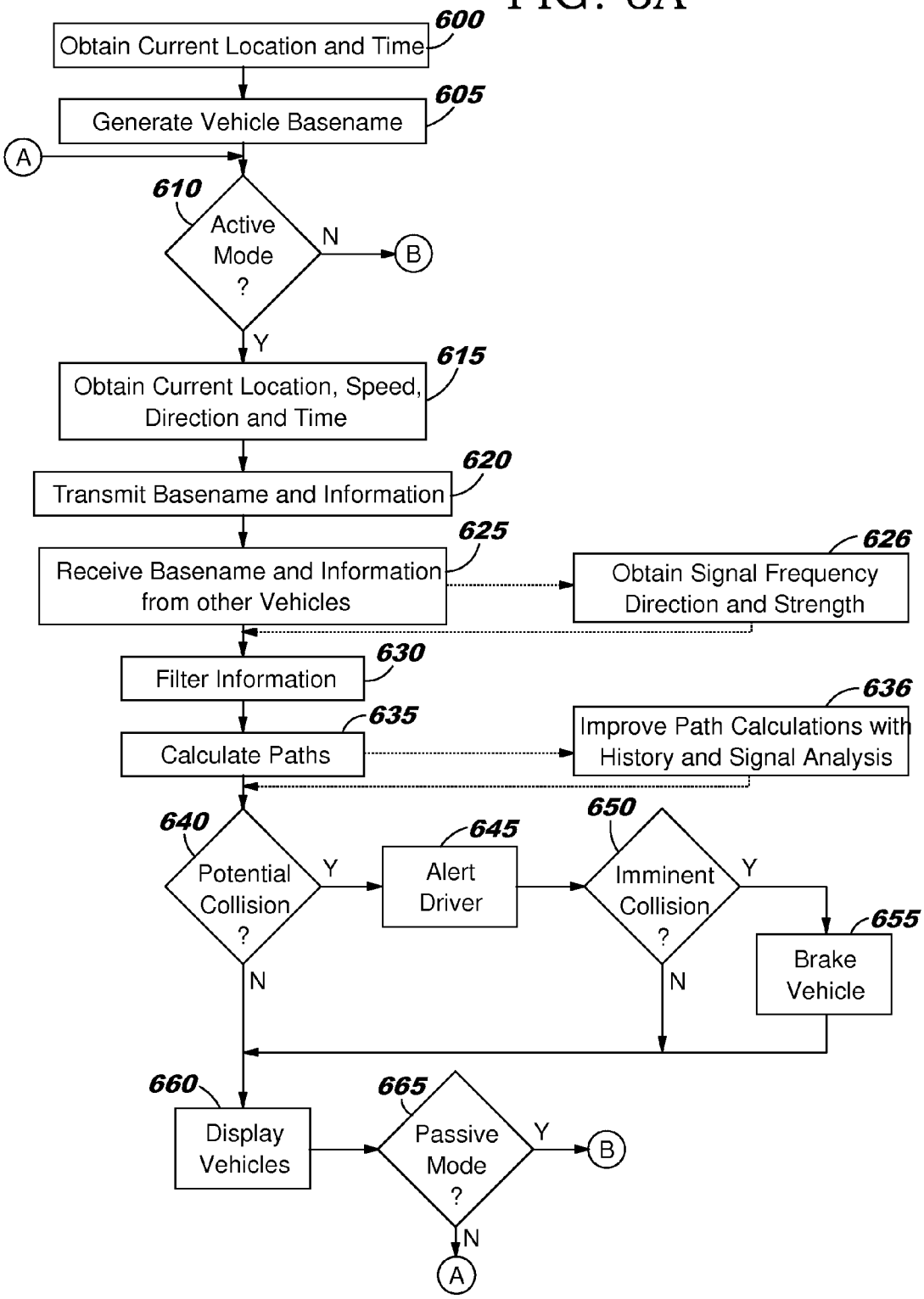
FIGS. 6A and 6B are flow diagrams of the operation of the vehicular system for detecting and displaying nearby vehicles in which various embodiments may be implemented.
Figure 6B:
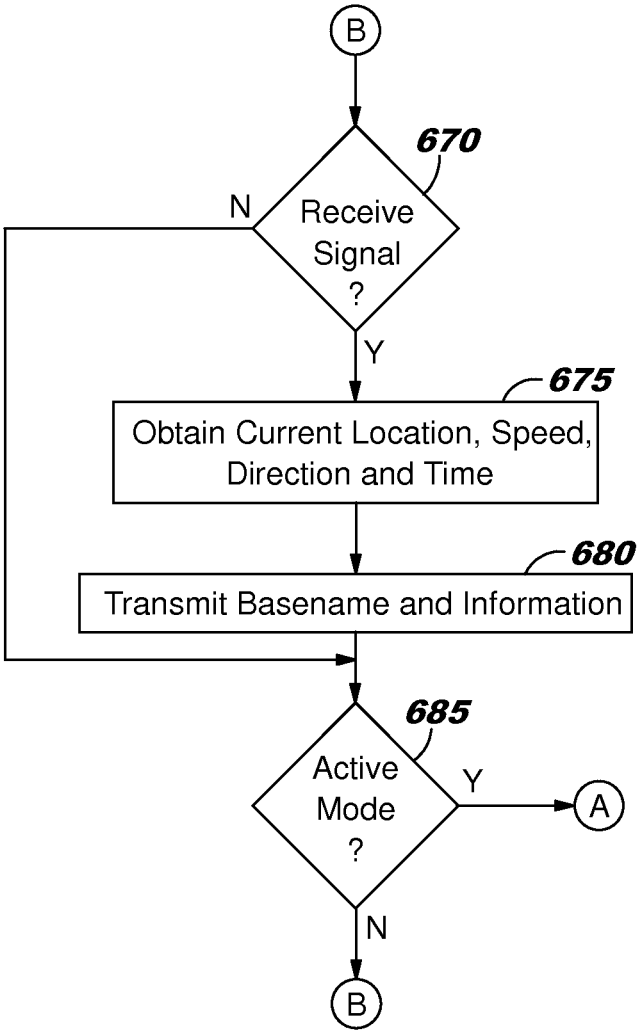

FIGS. 6A and 6B are flow diagrams of the operation of a vehicular system for detecting and displaying nearby vehicles in which various embodiments may be implemented. In a first step 600, typically performed when this vehicle is started or when the system is turned on, the system determines the current location of the vehicle and the current time. The location is typically in latitude and longitude. This step may be accomplished utilizing the vehicle GPS tracker. Subsequently in step 605, the time and location of this vehicle are used to generate a temporary basename. The generation of the basename includes performing a checksum or otherwise hashing the combination of location and time. This process is described in greater detail below with reference to FIG. 7. The basename is intended to be a unique portion of a temporary name for this vehicle in wireless communications while preserving the privacy and anonymity of this vehicle and driver. Because of the hashing, the underlying starting location of this vehicle cannot be determined from the hashed basename.

In step 610, it is determined whether this vehicle is in active mode. Active mode is the preferred mode of operation and this vehicle will remain in the active mode unless the user (e.g. driver) or other entity changes this system to a passive mode. If not in an active mode, then processing proceeds to step 670 of FIG. 6B. If in an active mode, then processing proceeds to step 615. In step 615, the vehicular system obtains the current location (e.g. latitude and longitude), speed, direction and time. Speed and direction are optional, but preferred, as they can also be derived from any two transmissions of location by a vehicle. Then in step 620, that information is combined with the basename and transmitted by the wireless controller as an address for reception by other nearby vehicles. It is preferred that the transmission be short range such as Bluetooth. It is also preferred that the combination of basename and other information is transmitted as a temporary address of this vehicle. As a result, no connection needs to be established to share this information with other vehicles. The use of a basename allows other vehicles to distinguish this vehicle from other vehicles providing similar information. The temporary name is described further below with reference to FIG. 7. Processing then continues to step 625.

In step 625, the vehicular system listens and obtains the temporary names of other vehicles within range. This would be limited to those vehicles which use a similar vehicular system. It is preferred that the other vehicles also transmit their information using short range communications such as Bluetooth. These obtained temporary names include the unique basenames of each vehicle as well as their current location, speed and direction. If the speed and direction are not provided, they can be derived from subsequent transmissions from the same vehicle. Optionally in step 626 the vehicular system also obtains the signal attributes such as frequency, direction and strength, which can also be used to calculate the relative speed, relative direction and relative distance of other vehicles. Subsequently in step 630, the temporary names of other vehicles are filtered based on location. For example, if another vehicle is behind this vehicle, then it poses little risk to this vehicle. This is especially true if direction and speed are also considered and it is determined that the other vehicle is behind and headed the other direction, or behind and traveling slower than this vehicle, then that vehicle poses no threat to this vehicle. As a result, the temporary names of those filtered vehicles may be ignored in subsequent processing. Processing then continues to step 635.

In step 635 the vehicular system calculates the paths of the other vehicles that were not filtered out to determine their relative position, speed and direction. The paths are calculated by the processor including the relative location, speed and direction of other vehicles using the information provided from the other vehicles. This can include the GPS coordinates provided by each vehicle as well as any speed, direction or other information which may have been provided by the other vehicles. In addition, if speed and direction are not provided by another vehicle, the time and prior location of that vehicle from recent prior wireless communication(s) may be used to calculate the speed and direction of that vehicle. Optionally in step 636 the processor also utilizes any recent history of a vehicle stored in memory as well as the signal attributes such as frequency, direction and strength to optimize the calculated relative speed, relative direction and relative distance of other vehicles. For example, a change in wireless signal frequency may indicate a change in speed due to the Doppler effect. All this updated information can then be stored in memory in steps 635 and or 636 for use in the near future.

From this information, the vehicular system is able to determine whether any of the other vehicles pose a potential risk of a collision with this vehicle, and to determine whether the risk of such collision is imminent. From this information, in step 640 it is determined whether there is a potential risk of potential collision with any other vehicle. If not, then processing continues to step 660. If there is a potential risk of a collision, then in step 645 a warning is provided to the driver of this vehicle. That warning may be audible, visual or both. For example, a certain buzzer sound may be provided to the driver and a display of vehicles may indicate which vehicle is posing the potential risk. Alternative embodiments may provide alternative types of warning including tactile warning such as a vibrating steering wheel. As the driver is being alerted, in step 650 it is determined whether the collision in imminent. If not, then processing continues to step 660. If such a collision is imminent, then in step 655 the braking system of this vehicle can be activated to slow this vehicle. Other actions may be taken such as turning off the accelerator and cruise control system. Alternative embodiments may take other actions as deemed necessary by that embodiment including affecting the steering of the vehicle to avoid the collision. Processing then continues to step 660.

In step 660, other vehicles are displayed on the vehicle display. The vehicles displayed may vary depending on the type of information being displayed. For example, the display of vehicles may be limited to those within a visual range if the display is set for display only that which is ahead of the driver. However, if the display is set for an overhead view, then all vehicles that were not filtered out within range of this vehicle may be displayed.

Finally, in step 665 it is determined whether this vehicle may be in passive mode. That may be caused by the driver or other user pressing passive mode on the display. For example, if the vehicle is in a traffic jam where there is little movement, then the driver may want a passive mode to avoid cluttering the displayed roadway with other vehicles within visual range. Also, if the vehicle enters an area with sensitive electronics, the vehicle may receive a signal to temporarily enter a passive mode to avoid jamming those electronics. If a passive mode is not selected, then processing returns to step 610, otherwise processing continues to step 670 of FIG. 6B.

FIG. 6B is directed to the actions taken by the vehicular system when that system is in a passive mode. In such a mode, this vehicle takes very little action except for providing a location signal (basename plus location information) to other vehicles querying for such information. As a result, the driver or other user does not receive any warning of potential collisions and no vehicles are displayed on the display viewed by the driver or other user. This mode may be selected when this vehicle is in a traffic jam with little or no vehicle movement and the user wants to see the map without the clutter of other vehicles on the display. Also, if the vehicle enters an area with sensitive electronics, the vehicle may receive a signal to temporarily enter a passive mode to avoid jamming those electronics. In step 670 of FIG. 6B it is determined whether this vehicle has received any signals from other vehicles. If yes, then processing continues to step 675. If not, then no action is taken and processing continues to step 685. It is preferred that the other vehicles transmit their information using short range communications such as Bluetooth, thereby limiting the number of times this vehicle receives signals from other vehicles, especially while this vehicle is in the passive mode.

In step 675, the vehicular system obtains the current location, speed, direction and time from the GPS tracker. Then in step 680 that information is combined with the basename and transmitted by the wireless controller as an address for reception by other nearby vehicles. It is preferred that the transmission be short range such as Bluetooth. It is also preferred that the combination of basename and other information is transmitted as a temporary address of this vehicle. As a result, no connection needs to be established to share this information with other vehicles. The use of a basename allows other vehicles to distinguish this vehicle from other vehicles providing similar information. The temporary name is described further below with reference to FIG. 7. Processing then continues to step 685. In step 685 it is determined whether this vehicle has changed to active mode. If not, then processing returns to step 670, otherwise processing returns to step 610 of FIG. 6A.

Figure 7:
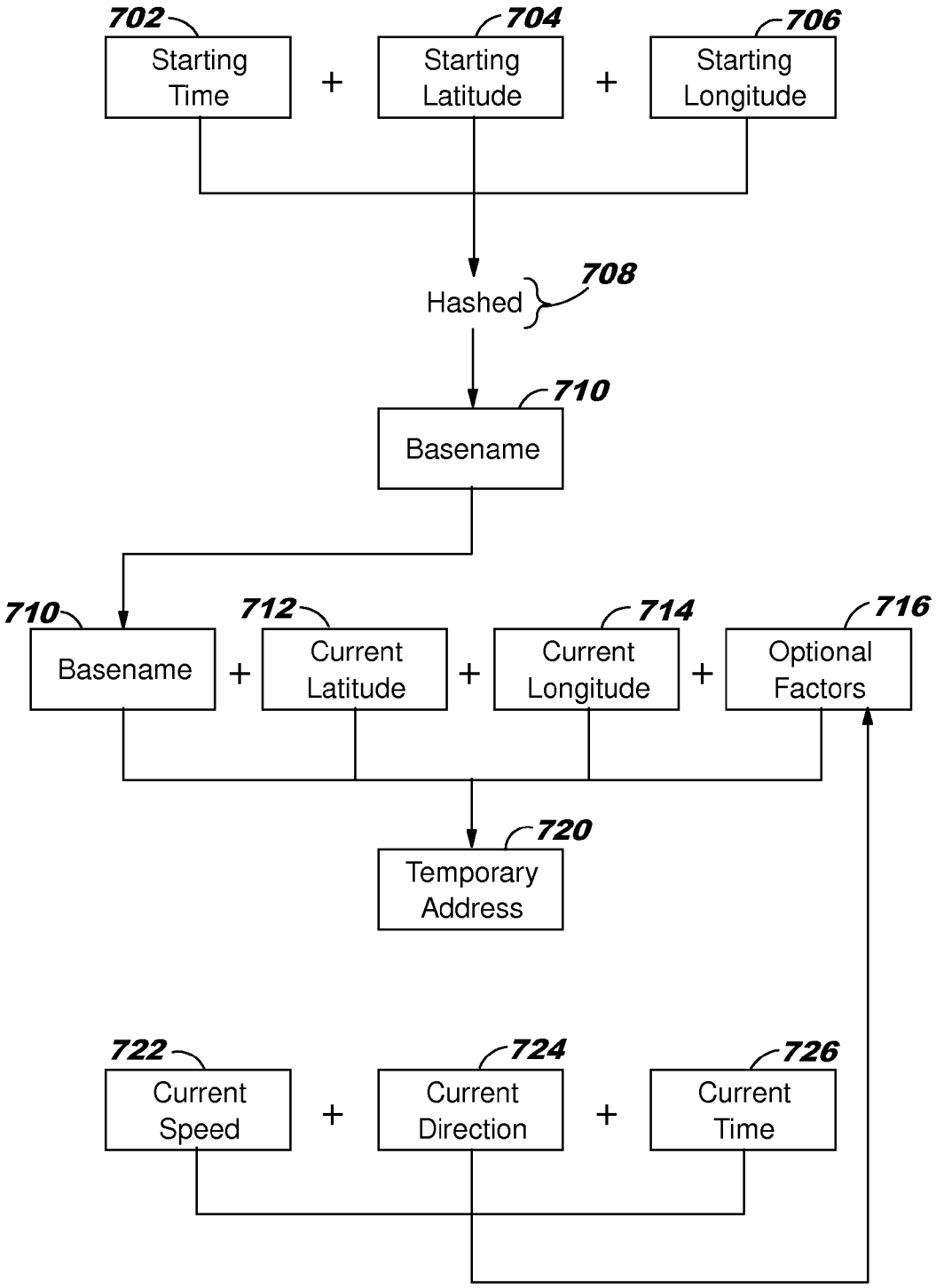
FIG. 7 is a block diagram of a temporary name being generated in which various embodiments may be implemented.

FIG. 7 is a block diagram of a temporary name being generated in which various embodiments may be implemented. As described above in FIG. 6A, a starting time 702 and location (latitude 704 and longitude 706) of the vehicle are combined and then hashed 708 to generate a basename 710. In alternative embodiments, other types of factors could be utilized or included such as the MAC of the wireless device. In addition, the order of the time and location could be exchanged and only portions of the time and location may be utilized. Various types of hashing such as checksum may be utilized, or other types of algorithms may be utilized to disguise the underlying factors included in the basename. The basename is intended to be a unique portion of a temporary name for this vehicle in wireless communications while preserving the privacy and anonymity of this vehicle and driver. Because of the hashing, the underlying starting location of this vehicle cannot be determined from the hashed basename.

Basename 710 is then combined with the current latitude 712 of the vehicle, current longitude 714 of the vehicle, and other optional factors 716 to generate a temporary address 720. The order of these factors may be exchanged in alternative embodiments. These factors are combined as a temporary name to be utilized by the wireless device. As a result, no connection needs to be established to share this information with other vehicles. The use of a basename within the temporary name allows other vehicles to distinguish this vehicle from other vehicles providing similar information.

Optional factors 716 can include a combination of the current speed 722 of the vehicle, current direction 724 of the vehicle, and the current time 726. The current speed and direction may be calculated by other vehicles from two or more sequential temporary names without such information. That is, by comparing the location of a vehicle at two or more times, one can easily determine the speed and direction of that vehicle. The current time can also be included in case there are any small delays in transmitting and receiving the temporary addresses. This would allow for greater precision, particularly if the vehicles are traveling at a high rate of speed. Alternative embodiments may also provide an indicator whether the vehicle sending the temporary address are in an active or passive mode. As a result, a vehicle in a passive mode may only respond to vehicles sending a temporary address with an active mode indicator.

Only those vehicles similarly equipped are detected using the above described embodiments. As a result, additional forms of vehicle detection may be utilized until most or all vehicles on the road are similarly equipped.

The invention can take the form of an entirely software embodiment, or an embodiment containing both hardware and software elements. In a preferred embodiment, the invention is implemented in software or program code, which includes but is not limited to firmware, resident software, and microcode.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, microcode, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM), or Flash memory, an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing. Further, a computer storage medium may contain or store a computer-readable program code such that when the computer-readable program code is executed on a computer, the execution of this computer-readable program code causes the computer to transmit another computer-readable program code over a communications link. This communications link may use a medium that is, for example without limitation, physical or wireless.

A data processing system suitable for storing and/or executing program code will include at least one processor coupled directly or indirectly to memory elements through a system bus. The memory elements can include local memory employed during actual execution of the program code, bulk storage media, and cache memories, which provide temporary storage of at least some program code in order to reduce the number of times code must be retrieved from bulk storage media during execution.

A data processing system may act as a server data processing system or a client data processing system. Server and client data processing systems may include data storage media that are computer usable, such as being computer readable. A data storage medium associated with a server data processing system may contain computer usable code such as for detecting and displaying other nearby vehicles. A client data processing system may download that computer usable code, such as for storing on a data storage medium associated with the client data processing system, or for using in the client data processing system. The server data processing system may similarly upload computer usable code from the client data processing system such as a content source. The computer usable code resulting from a computer usable program product embodiment of the illustrative embodiments may be uploaded or downloaded using server and client data processing systems in this manner.

Input/output or I/O devices (including but not limited to keyboards, displays, pointing devices, etc.) can be coupled to the system either directly or through intervening I/O controllers.

Network adapters may also be coupled to the system to enable the data processing system to become coupled to other data processing systems or remote printers or storage devices through intervening private or public networks. Modems, cable modem and Ethernet cards are just a few of the currently available types of network adapters.

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to explain the principles of the invention, the practical application, and to enable others of ordinary skill in the art to understand the invention for various embodiments with various modifications as are suited to the particular use contemplated.

The terminology used herein is for the purpose of describing particular embodiments and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A method of a wireless unit of a first vehicle detecting and locating other nearby vehicles comprising:

emitting a first short range wireless signal with the first wireless unit, the first wireless signal including a first unique identifier and a first location of the first vehicle;

detecting a second short range wireless signal of a second wireless unit of a second vehicle without the first wireless unit establishing a connection with the second wireless unit, the second wireless signal including a second unique identifier and a second location of the second vehicle; and computing a relative location of the second vehicle from the second wireless signal;

wherein the first wireless signal includes a first temporary address of the first wireless unit, the first temporary address including the first unique identifier and the first location of the first vehicle, and the second wireless signal includes a second temporary address of the second wireless unit, the second temporary address including the second unique identifier and the second location of the second vehicle.

2. The method of claim 1 wherein the first short range wireless signal and the second short range wireless signal are Bluetooth signals.

3. The method of claim 2-further comprising:

detecting a third short range wireless signal that is a Bluetooth signal from the second vehicle including a second unique identifier and a third location of the second vehicle; and computing a relative location, speed and direction of the second vehicle from the second and third wireless signals.

4. The method of claim 2 wherein the first vehicle enters a passive mode whereby the first wireless signal is sent only after receiving the second wireless signal.

5. The method of claim 1 wherein the first unique identifier includes a hashed prior location of the first vehicle and the second unique identifier includes a hashed prior location of the second vehicle.

6. The method of claim 1 wherein the first short range wireless signal includes a speed and a direction of the first vehicle, the second short range wireless signal includes a speed and a direction of the second vehicle, and the relative speed and direction of the first and second vehicle are computed.

7. The method of claim 6 further comprising:

determining whether the first vehicle and the second vehicle may collide; and upon a positive determination, warning a driver of the second vehicle.

8. The method of claim 7 further comprising engaging a braking system of the first vehicle upon a positive determination.

9. The method of claim 6 further comprising computing whether the second vehicle is behind the first vehicle, and upon a positive determination the relative speed and direction of the second vehicle are not computed.

10. The method of claim 1 wherein the step of computer includes analyzing at least one attribute of the second short range wireless signal.

11. A data processing system for a wireless unit of a first vehicle detecting and locating other nearby vehicles, the data processing system comprising:

a processor; and a memory storing program instructions which when executed by the processor execute the steps of:

emitting a first short range wireless signal with the first wireless unit, the first wireless signal including a first unique identifier and a first location of the first vehicle;

detecting a second short range wireless signal of a second wireless unit of a second vehicle without the first wireless unit establishing a connection with the second wireless unit, the second wireless signal including a second unique identifier and a second location of the second vehicle; and computing a relative location of the second vehicle from the second wireless signal;

wherein the first wireless signal includes a first temporary address of the first wireless unit, the first temporary address including the first unique identifier and the first location of the first vehicle, and the second wireless signal includes a second temporary address of the second wireless unit, the second temporary address including the second unique identifier and the second location of the second vehicle.

12. The data processing system of claim 11 wherein the first short range wireless signal and the second short range wireless signal are Bluetooth signals.

13. The data processing system of claim 11 wherein the first unique identifier includes a hashed prior location of the first vehicle and the second unique identifier includes a hashed prior location of the second vehicle.

14. The data processing system of claim 11 wherein the first short range wireless signal includes a speed and a direction of the first vehicle, the second short range wireless signal includes a speed and a direction of the second vehicle, and the relative speed and direction of the first and second vehicle are computed.

15. The data processing system of claim 14 further comprising:

determining whether the first vehicle and the second vehicle may collide; and upon a positive determination, warning a driver of the second vehicle.

16. A computer usable program product comprising a computer usable storage medium including computer usable code for use in a wireless unit of a first vehicle detecting and locating other nearby vehicles, the computer usable program product comprising code for performing the steps of:

emitting a first short range wireless signal with the first wireless unit, the first wireless signal including a first unique identifier and a first location of the first vehicle;

detecting a second short range wireless signal of a second wireless unit of a second vehicle without the first wireless unit establishing a connection with the second wireless unit, the second wireless signal including a second unique identifier and a second location of the second vehicle; and computing a relative location of the second vehicle from the second wireless signal;

wherein the first wireless signal includes a first temporary address of the first wireless unit, the first temporary address including the first unique identifier and the first location of the first vehicle, and the second wireless signal includes a second temporary address of the second wireless unit, the second temporary address including the second unique identifier and the second location of the second vehicle.

17. The computer usable program product of claim 16 wherein the first short range wireless signal and the second short range wireless signal are Bluetooth signals.

18. The computer usable program product of claim 16 wherein the first unique identifier includes a hashed prior location of the first vehicle and the second unique identifier includes a hashed prior location of the second vehicle.

19. The computer usable program product of claim 16 wherein the first short range wireless signal includes a speed and a direction of the first vehicle, the second short range wireless signal includes a speed and a direction of the second vehicle, and the relative speed and direction of the first and second vehicle are computed.

20. The computer usable program product of claim 19 further comprising:

determining whether the first vehicle and the second vehicle may collide; and upon a positive determination, warning a driver of the second vehicle.

* * * * *